US007077387B1

(12) United States Patent
White et al.

(10) Patent No.: US 7,077,387 B1
(45) Date of Patent: Jul. 18, 2006

(54) LIMITED ACCESS ADJUSTMENT SYSTEM FOR AN INTERNAL COMBUSTION ENGINE

(75) Inventors: Brian R. White, Stillwater, OK (US); Frank A. Robinson, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/129,200

(22) Filed: May 13, 2005

(51) Int. Cl.
*F02M 19/04* (2006.01)

(52) U.S. Cl. ..... 261/71; 137/382; 261/DIG. 38; 261/DIG. 84

(58) Field of Classification Search ..... 261/71, 261/DIG. 38, DIG. 84; 137/382, 382.5; 411/301, 412, 542
See application file for complete search history.

(56) References Cited

U.S. PATENT DOCUMENTS

| | | | | |
|---|---|---|---|---|
| 4,097,561 | A * | 6/1978 | Seki et al. | 261/41.5 |
| 4,271,095 | A * | 6/1981 | Maeda | 261/41.5 |
| 5,603,869 | A | 2/1997 | McNew et al. | 261/71 |
| 5,635,113 | A | 6/1997 | Walsh et al. | 261/71 |
| 5,707,561 | A * | 1/1998 | Swanson | 261/71 |
| 5,753,148 | A | 5/1998 | King et al. | 261/71 |
| 5,984,281 | A | 11/1999 | Hacker et al. | 261/71 |
| 6,302,383 | B1 * | 10/2001 | Scarr | 261/71 |
| 6,691,988 | B1 | 2/2004 | Warfel et al. | 261/71 |
| 6,708,959 | B1 | 3/2004 | Dow | 261/65 |
| 2004/0007788 | A1 * | 1/2004 | Vimercati | 261/71 |

FOREIGN PATENT DOCUMENTS

| | | | | |
|---|---|---|---|---|
| JP | 53-88422 | * | 8/1978 | 261/71 |

* cited by examiner

*Primary Examiner*—Richard L. Chiesa
(74) *Attorney, Agent, or Firm*—William D. Lanyi

(57) ABSTRACT

An adjustment system for a carburetor of an engine places a housing structure around the head of an adjustment screw to inhibit access to the head of the idle fuel adjustment screw except by properly trained technicians who possess an appropriately shaped tool which allows this access. In this way, the housing can function as intended, to limit access by untrained personnel to the idle fuel adjustment screw, while not requiring that it be completely removed or destroyed in order to allow appropriate access by trained personnel.

18 Claims, 6 Drawing Sheets

LIMITED ACCESS ADJUSTMENT SYSTEM FOR AN INTERNAL COMBUSTION ENGINE

BACKGROUND OF THE INVENTION

1. Field of the Invention

The present invention is generally related to an adjustment system for an engine and, more particularly, to an adjustment system which limits access to an idle fuel mixture screw.

2. Description of the Related Art

U.S. Pat. No. 5,603,869, which issued to McNew et al. on Feb. 18, 1997, describes a fuel mixture limitation device. The device limits post-adjustment rotation of an adjustment screw on single adjustment screw carburetors. On one embodiment, the limitation device uses a limiter cap removably attached to the adjustment screw which works in conjunction with a limiter stop attached to the carburetor.

U.S. Pat. No. 5,635,113, which issued to Walsh et al. on Jun. 3, 1997, describes a carburetor adjustment screw apparatus. The apparatus is intended for use with a diaphragm-type carburetor and it comprises a screw member having a shaft and a head by which the shaft may be rotated, with a generally tubular open-ended housing surrounding the head of the screw member. A cap member is mounted in the housing and is movable axially of the screw member between a first position and a second position.

U.S. Pat. No. 5,753,148, which issued to King et al. on May 19, 1998, describes a carburetor needle valve adjustment limiter cap apparatus. The limiter cap has a hollow cylindrical outer body of rigid material. It carries a limiter arm. A spring steel hollow retainer clip sleeve is telescopically received in the body and has inwardly and outwardly protruding resilient barbs reversely oriented relative to one another to respectively engage the cap body and the needle valve shank to respectively prevent retrograde relative telescopic motion between the clip and the body and between the clip and the valve shank.

U.S. Pat. No. 5,984,281, which issued to Hacker et al. on Nov. 16, 1999, describes a carburetor needle valve and limiter cap installation and adjustment apparatus. It describes an improvement in a limiter cap holder wherein the clip spring legs are interconnected by a spring web that flexes to accommodate flexing of the clip legs free ends during insertion of the associated limiter caps into the retaining clip and prolongs the effective friction grip service life of the clip.

U.S. Pat. No. 6,691,988, which issued to Warfel et al. on Feb. 17, 2004, describes a tamper resistant carburetor mixture needle. The adjustment screw arrangement is intended for use with a carburetor. The arrangement includes a carburetor body having at least one air/fuel adjustment screw threaded therein. The adjustment screw has a threaded shank and a head portion. The head portion is defined by a smooth top surface and an undulant, uneven side surface capable of being engaged and mated by an adjusting tool having a complementary undulant, uneven side surface capable of being engaged and mated by an adjusting tool having a complementary undulant, uneven surface for initial adjustment of the air/fuel mixture in the carburetor.

U.S. Pat. No. 6,708,959, which issued to Dow on Mar. 23, 2004, describes a carburetor valve assembly. It has a plastic cam body connected to a plastic shaft which extends into the carburetor body and valve head press-fit into a slot formed through the plastic shaft.

The patents described above are hereby expressly incorporated by reference in the description of the present invention.

Environmental restrictions require that threaded adjustment needles of carburetors be protected from improper manipulation. These regulations are intended to prevent the users of engines from improperly calibrating the idle fuel mixture ratio and, as a result, causing an engine to emit excessive pollutants. Most of these protective devices also inhibit the proper adjustment of the idle fuel mixture screw by a trained technician, such as the personnel of an engine repair facility. As a result, the adjustment of the idle fuel device requires excessive effort on the part of the skilled technician.

It would therefore be significantly beneficial if a device could be developed which inhibits the adjustment of the idle fuel screw by unqualified personnel while allowing the proper adjustment of that idle fuel screw by trained personnel whose responsibility it is to properly calibrate the engine and appropriately set the idle fuel adjustment screw.

SUMMARY OF THE INVENTION

An adjustment system for an engine, made in accordance with a preferred embodiment of the present invention, comprises an engine component, such as a carburetor, a rotatable adjustment member, such as an idle fuel mixture screw, and a housing. The rotatable adjustment member is shaped to be supported by the engine component for rotation about a rotational axis. It has a first end which is insertable into a retention opening formed in the engine component in a preferred embodiment of the present invention. The rotatable adjustment member has a second end extending away from the engine component. A head is formed at the second end of the rotatable adjustment member. The housing is shaped to at least partially surround the head. The rotational axis of the rotatable adjustment member extends through a first surface of the housing. An access opening is formed in the first surface. The rotational axis of the rotatable adjustment member extends through the access opening.

The rotatable adjustment member is threaded into the retention opening in a preferred embodiment of the present invention. This preferred embodiment can further comprise an adjustment tool which is shaped to pass at least partially through the access opening. The adjustment tool has an operative end which is shaped to engage the head in torque transmitting relation. The operative end can have a pair of inwardly facing surfaces which are shaped to receive a pair of outwardly facing surfaces of the head therebetween. The access opening can be a round hole which extends through the first surface. The round hole can have a diameter which is greater than a maximum thickness dimension of the operative end of the tool. The diameter is greater than a maximum thickness dimension of the head in a preferred embodiment of the present invention.

The rotational axis of the rotatable adjustment member is generally perpendicular to the first surface in a preferred embodiment of the present invention and an internal surface of the housing defines a cavity, with the head being spaced apart from the internal surface of the housing. The area of the access opening is less than twenty five percent of the area of the first surface in a preferred embodiment of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
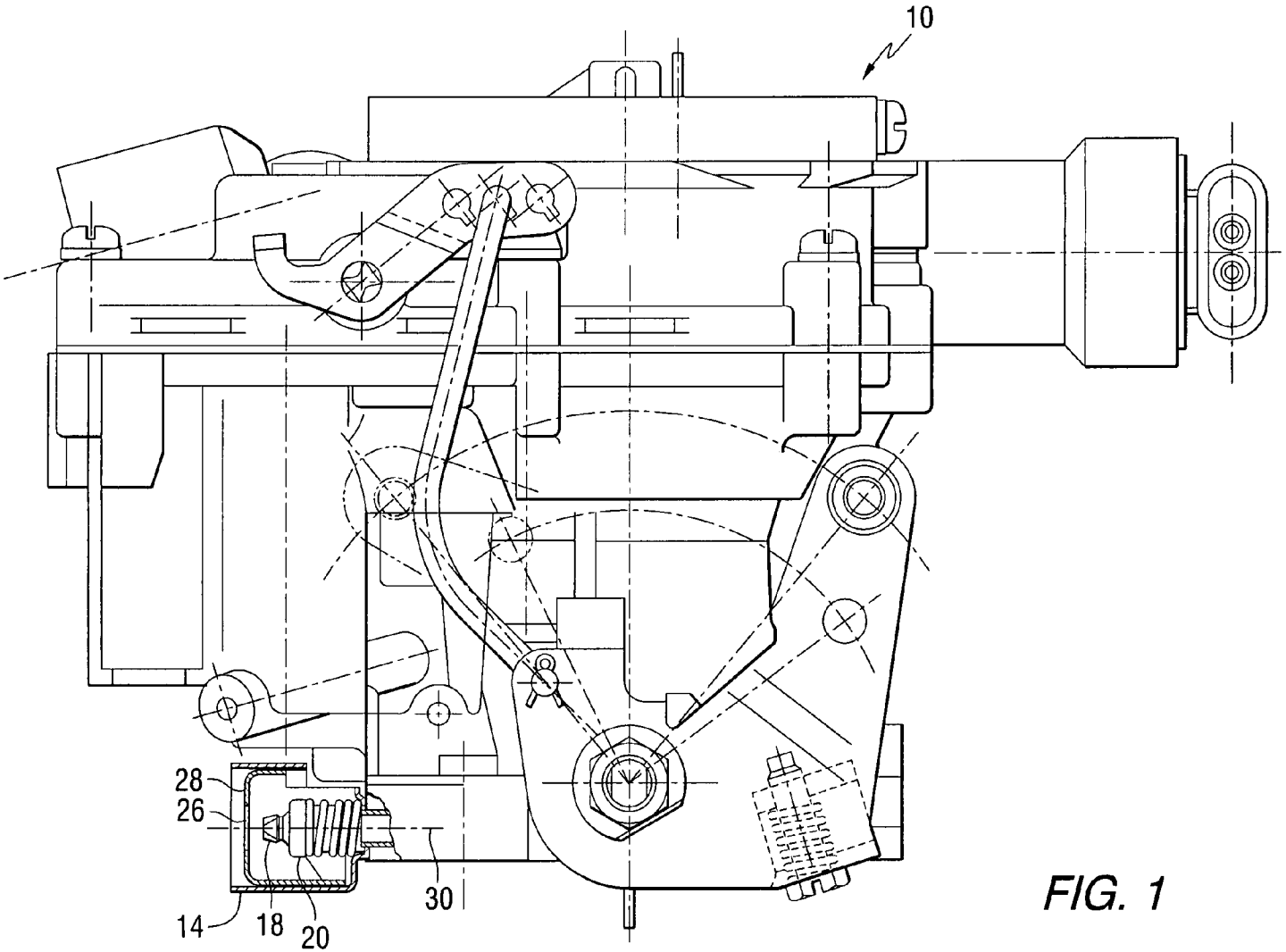
FIG. 1 is an illustration of a carburetor with the adjustment system of the present invention shown attached thereto.

Throughout the description of the preferred embodiment of the present invention, like components will be identified by like reference numerals.

FIG. 1 is a side view of a carburetor 10 with which the adjustment system of the present invention can be used. Reference numeral 14 identifies a housing, shown as a section view in FIG. 1, which is shaped to at least partially surround a head 18 of a rotatable adjustment member 20. An access opening 26 is formed in a first surface 28 of the housing 14. The other portions of the carburetor 10 are generally well known to those skilled in the art and will not be described in detail herein. The rotatable adjustment member 20 is shaped to be supported by the carburetor 10 for rotation about a rotational axis 30.

Figure 2:
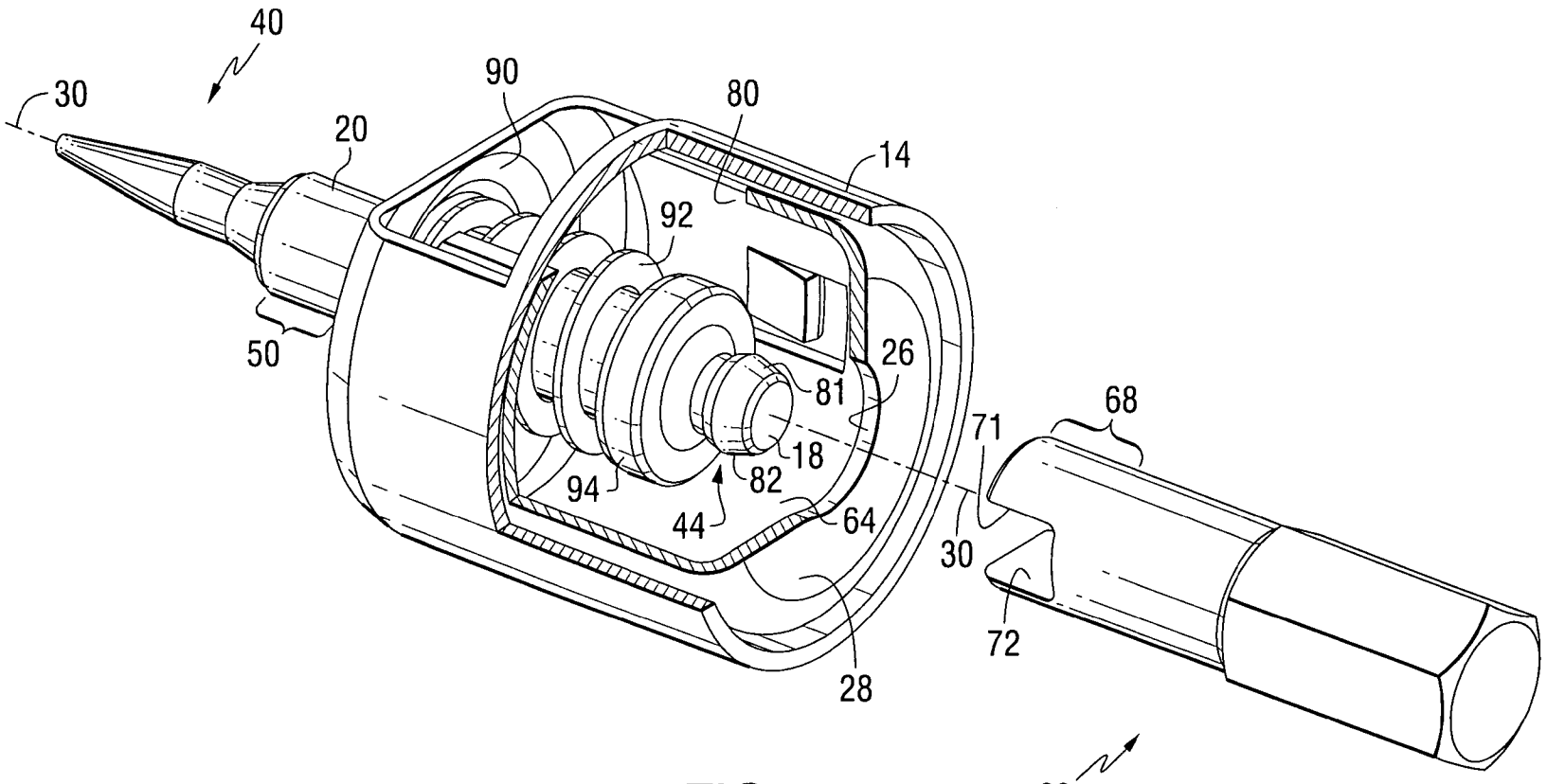
FIG. 2 is a sectioned isometric view of the present invention in association with its adjustment tool.

FIG. 2 is an isometric section view of the adjustment system, shown removed from the carburetor 10 for purposes of clarity and to facilitate the explanation of its various components. The rotatable adjustment member 20 has a first end 40 which is insertable into a retention opening formed in the carburetor. The rotatable adjustment member 20 has a second end 44 which extends away from the engine component. The head 18 is formed at the second end 44 of the rotatable adjustment member 20. The housing 14 is shaped to at least partially surround the head 18, as illustrated in the section view of FIG. 2. The rotational axis 30 of the rotatable adjustment member 20 extends through the first surface 28 of the housing 14. The access opening 26 is formed in the first surface 28. The rotational axis 30 of the rotatable adjustment member 20 extends through the access opening 26 as illustrated in FIG. 2.

As described above, in a preferred embodiment of the present invention, the rotatable adjustment member 20 is an idle fuel mixture screw and the engine component is a carburetor 10. The rotatable adjustment member 20 is threaded into the retention opening of the carburetor 10, with threads that are provided on the barrel-shaped portion 50 identified in FIG. 2. Although the threads are not illustrated in FIG. 2 at the portion 50, it should be understood that machine threads are provided on this outer cylindrical surface so that the rotatable adjustment member 20 can be threaded into the retention opening of the carburetor 10 which is similarly threaded.

With continued reference to FIG. 2, an adjustment tool 60 is shaped to pass at least partially through the access opening 26 and into the cavity 64 defined by the housing structure 14. The adjustment tool 60 has an operative end 68 which is shaped to engage the head 18 in torque transmitting relation. The operative end 68 has a pair of inwardly facing surfaces, 71 and 72, which are shaped to receive a pair of outwardly facing surfaces, 81 and 82, of the head 18. Although outwardly facing surface 82 and inwardly facing surface 71 are not clearly visible in FIG. 2, they will be described in greater detail below.

With continued reference to FIG. 2, it can be seen that in a preferred embodiment of the present invention, the access opening 26 is a round hole which extends through the first surface 28. The round hole, which is shown in section view in FIG. 2, has a diameter which is greater than a maximum thickness dimension of the operative end 68 of the tool 60. The diameter of the access hole 26 is also greater than a maximum thickness dimension of the head 18 in a preferred embodiment of the present invention. The rotational axis 30 of the rotatable adjustment member 20 is generally perpendicular to the first surface 28 in a preferred embodiment. An internal surface 80 of the housing 14 defines the cavity 64 and the head 18 is spaced apart from the internal surface 80 of the housing 14. In other words, the head 18 is supported in non-contact association with the internal surface 80 of the housing 14 and is generally surrounded by the walls of the housing 14. The cross-sectional area of the access opening 26, in a particularly preferred embodiment of the present invention, is less than twenty five percent of the total cross-sectional area of the first surface 28. In a particularly preferred embodiment of the present invention, the diameter of the access opening 26 is approximately 6.5 millimeters. The effective diameter of the first surface 28, in that same preferred embodiment, is approximately 17.0 millimeters. As a result, the cross-sectional area of the access opening 26 is less than twenty five percent of the area of the first surface 28. Minimizing the relative area of the access opening 26, in this way, helps to inhibit inappropriate access to the head 18 by personnel who are not properly qualified to make the associated adjustments in the operation of the carburetor 10. That is the purpose of providing the protective housing 14 around the head 18 of the idle fuel mixture screw 20. However, the operative end 68 of the tool 60 is shaped and sized to pass through the access opening 26 to allow a trained technician to rotate the rotatable adjustment member 20 as needed to make a proper adjustment of the operation of the carburetor 10.

With continued reference to FIG. 2, it can be seen that the first end 40 of the rotatable adjustment member 20 extends through a rear surface 90 of the housing 14 to allow the threaded portion 50 to engage threads of the retention opening of the carburetor 10. In addition, a spring 92 is located between the rear surface 90 and an enlarged collar 94 formed on the rotatable adjustment member 20. This spring 92 exerts a force which retains the housing 14 in position as shown in FIG. 1.

Figure 3:
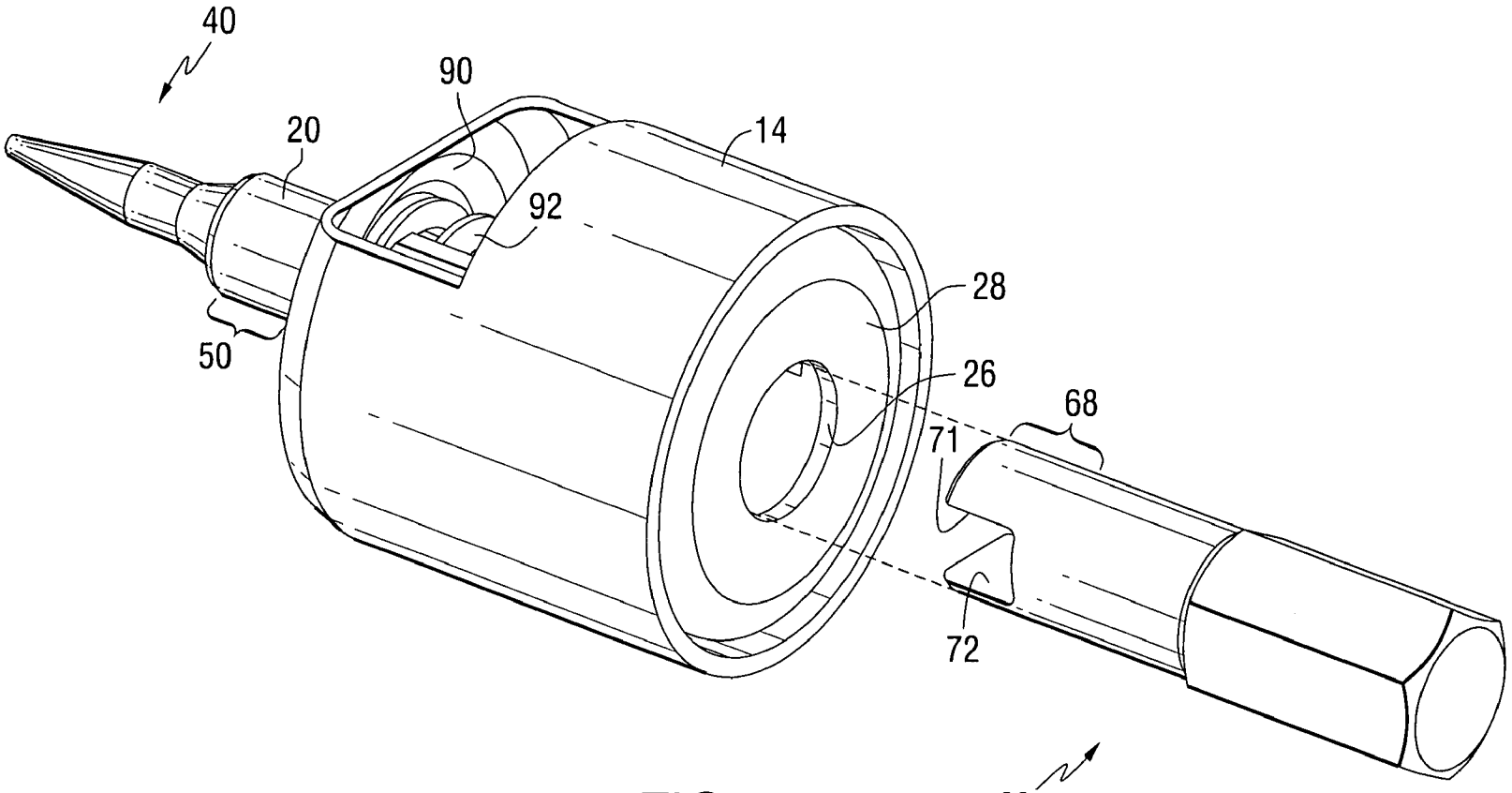
FIG. 3 is similar to FIG. 2, but not sectioned.

FIG. 3 is an isometric representation of the adjustment system of a preferred embodiment of the present invention, without the sectioning of the housing 14. The generally round shape of the access opening 26 is shown aligned, by dashed lines, with the operative end 68 of the tool 60 for the purpose of illustrating how the tool 60 can allow access to the head 18 for purposes of permitting a skilled technician to properly adjust the idle fuel mixture of the carburetor.

Figure 4:
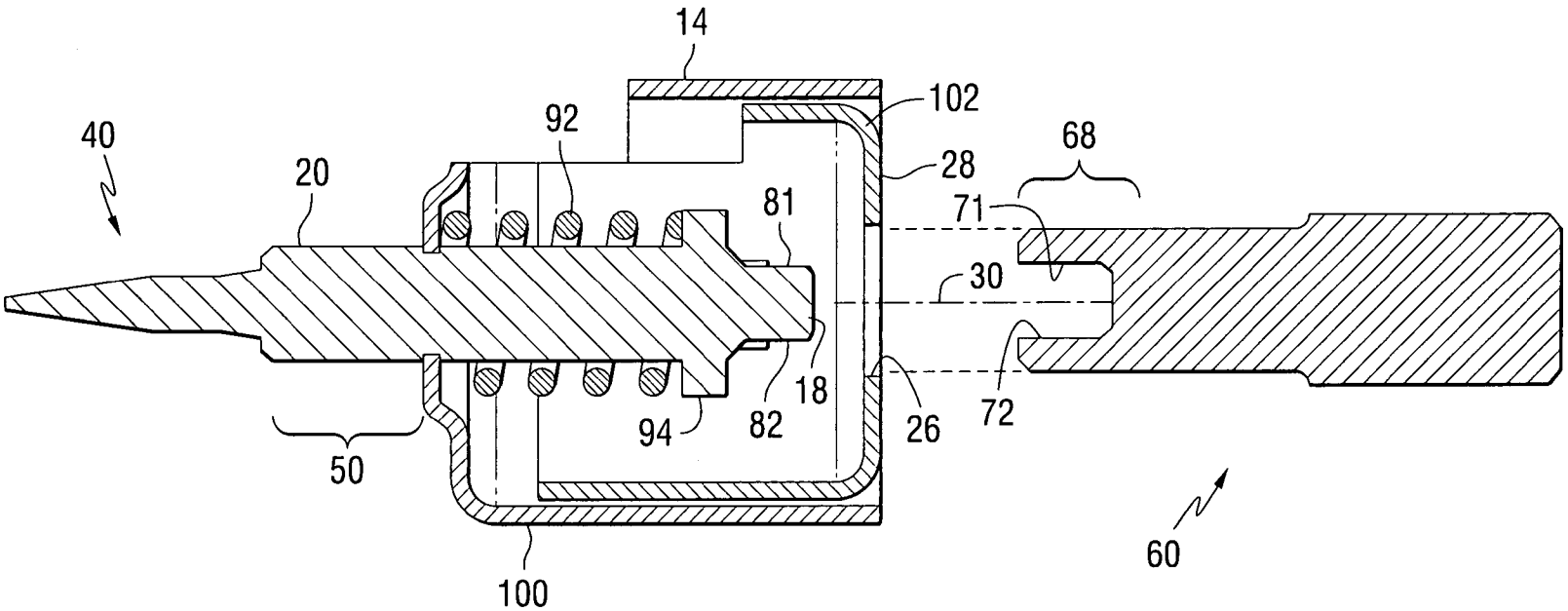
FIG. 4 is a side sectioned view of the present invention in association with its adjustment tool.

FIG. 4 is a side section view of the components illustrated in FIGS. 2 and 3. In the section view of FIG. 4, the relative size of the access opening 26 and the operative end 68 of the tool 60 can be compared by observing the dashed lines which align the operative end 68 of the tool 60 with the access opening 26. The operative end 68 can be inserted through the first surface 28 and into contact with the head 18. The inwardly facing surfaces, 71 and 72, of the tool 60 can then engage the outwardly facing surfaces, 81 and 82, of the head 18 to allow torque to be applied to the rotatable adjustment member 20 to cause it to rotate about its rotational axis 30. This allows an expert technician to make adjustments in the idle fuel mixture even though access to the head 18 is denied to unauthorized personnel who are not in possession of a tool such as the adjustment tool 60. A conventional screw driver will not be able to cause the rotatable adjustment member 20 to rotate about axis 30.

With continued reference to FIG. 4, it can be seen that the housing structure 14 is a combination of a first generally tubular member 100 and a second generally tubular member 102 which are assembled together to form the housing structure 14. Although the relative sizes of the access opening 26 and the first surface 28 have been described above as having the access opening being less than twenty five percent of the area of the first surface 28, it should be understood that alternative embodiments of the present invention could function as intended if the access opening is less than thirty percent of the area of the first surface 28 or, alternatively, if the access opening 26 is less than fifty percent of the area of the first surface 28. The important characteristic of this relationship is that the access opening 26 be sufficiently small, in relation to the first surface 28 and the head 18 of the idle fuel mixture screw 20, to inhibit easy access to the head 18 by those who are not properly trained to perform the adjustment or calibration of the idle fuel mixture screw. Ideally, a particularly preferred embodiment of the present invention would incorporate an access opening 26 that is at a minimum possible diameter which is sufficient to allow the operative end 68 of the tool 60 to pass therethrough to engage the head 18, but not large enough to allow easy access to an untrained person using conventional tools, such as needle-nose pliers or screw drivers.

Figure 5:
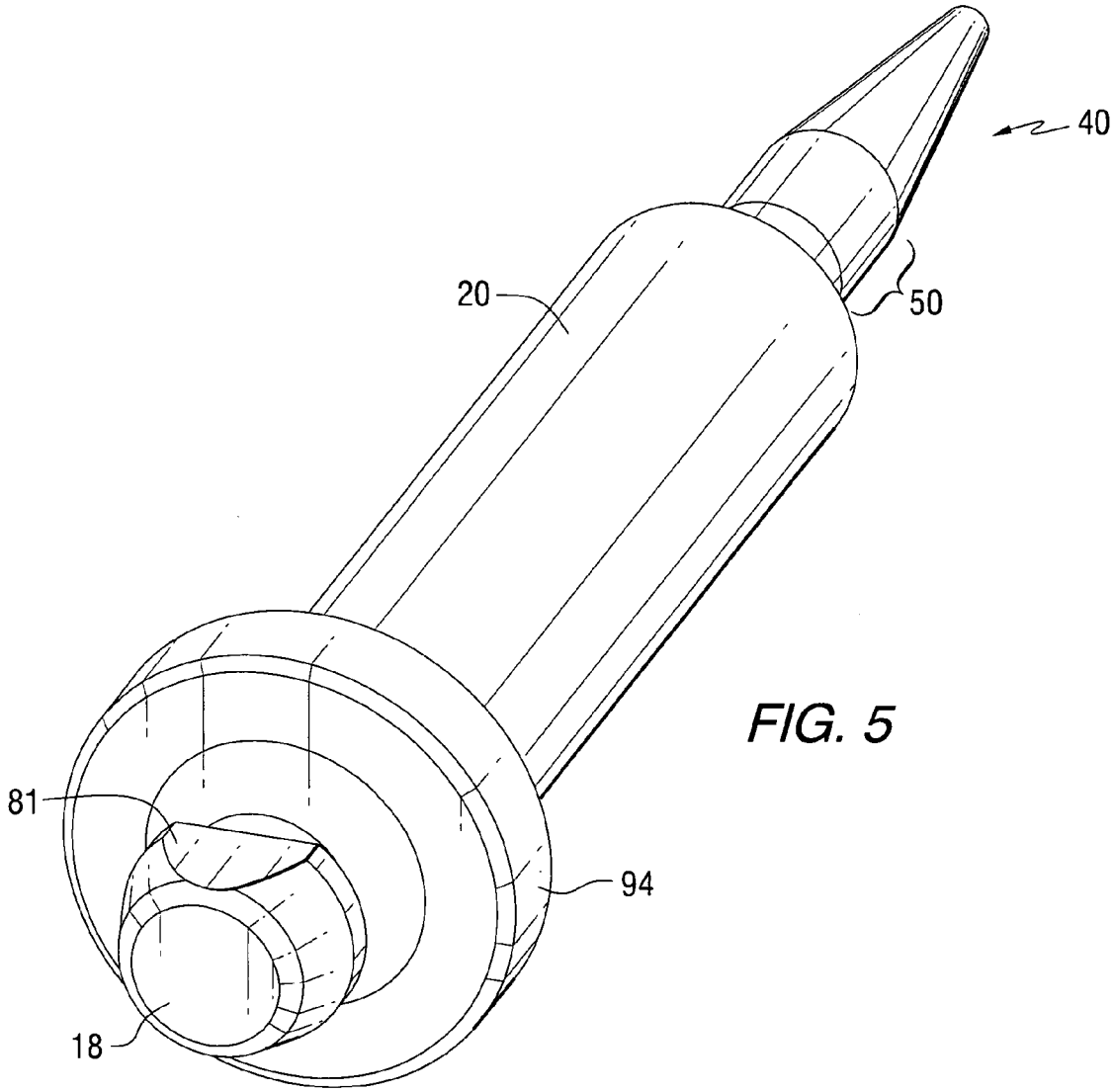
FIG. 5 is an isometric view of the rotatable adjustment member or idle fuel adjustment screw.
Figure 6:
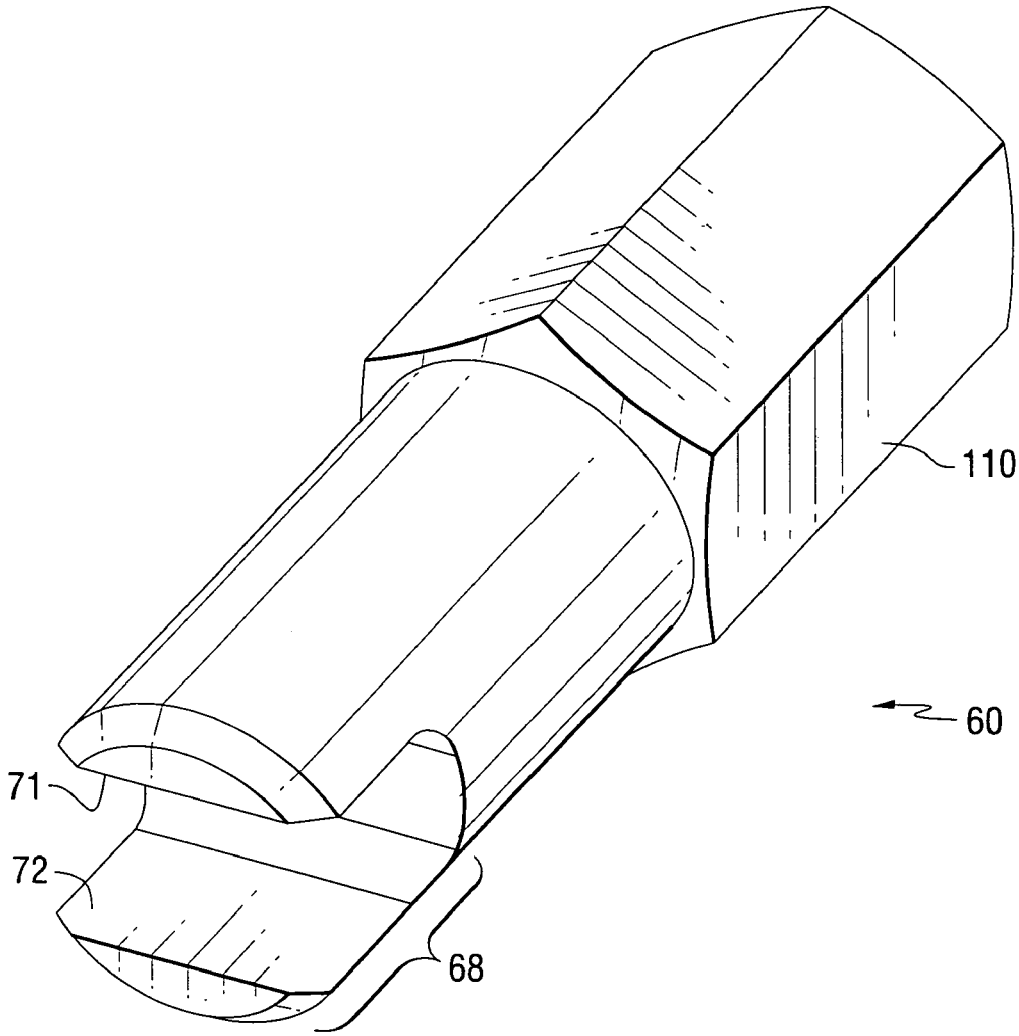
FIG. 6 is an isometric view of the adjustment tool of the present invention.

FIG. 5 is an enlarged isometric view of the rotatable adjustment member 20 and FIG. 6 is an enlarged isometric view of the adjustment tool 60. The collar 94 on the rotatable adjustment member 20 is sized, in a particularly preferred embodiment of the present invention, to prevent the rotatable adjustment member 20 from passing completely through the access opening 26 in a direction out of the cavity 64. In other words, the head 18 is shaped to pass into the access opening 26 under certain conditions, but the collar 94 limits the total movement of the rotatable adjustment member 20 in a direction through the access opening 26 in the first surface 28. As is generally known to those skilled in the art, the first end 40 of the rotatable adjustment member is shaped to allow adjustment of fuel passing through a conduit. This is accomplished through the use of the tapered tip at the first end 40. The tool 60 is provided with a hex-shaped portion 110 at the end which is opposite from the operative end 68. This facilitates the use of a wrench or similar tool to exert torque on the tool 60 which, in turn, is transmitted through the inwardly and outwardly directed surfaces, 71, 72, 81, and 82, to the rotatable adjustment member 20.

With reference to FIGS. 1–6, a particularly preferred embodiment of the present invention provides a carburetor 10 and an idle fuel mixture screw 20 which is shaped to be supported by the carburetor 10 for rotation about a rotational axis 30. The idle fuel mixture screw 20 has a first end 40 which is insertable into a retention opening formed in the carburetor 10. The idle fuel mixture screw 20 has a second end which extends away from the carburetor 10. A head 18 is formed at the second end of the idle fuel mixture screw 20. A housing 14 is shaped to at least partially surround the head 18. The rotational axis 30 of the idle fuel mixture screw 20 extends through a first surface 28 of the housing 14. An access opening 26 is formed in the first surface 28 and the rotational axis 30 of the idle fuel mixture screw 20 extends through the access opening 26. An adjustment tool 60 is shaped to pass at least partially through the access opening 26. The adjustment tool 60 has an operative end 68 which is shaped to engage the head 18 in torque transmitting relation. The operative end 68 has a pair of inwardly facing surfaces, 71 and 72, which are shaped to receive a pair of outwardly facing surfaces, 81 and 82, of the head 18 therebetween. An internal surface 80 of the housing 14 defines a cavity 64 and the head 18 is spaced apart from the internal surface 80 of the housing 14. The area of the access opening 26, in one embodiment of the present invention, is less than fifty percent of the area of the first surface 28. The access opening 26 is a hole which extends through the first surface 28 and the hole is shaped to permit a maximum thickness dimension of the operative end 68 to pass therethrough. The rotational axis 30 of the idle fuel mixture screw 20 is generally perpendicular to the first surface 28.

Although the present invention has been described in particular detail and illustrated to show a preferred embodiment, it should be understood that alternative embodiments are also within its scope.

We claim:

1. An adjustment system for an engine, comprising:

an engine component;

a rotatable adjustment member shaped to be supported by said engine component for rotation about a rotational axis, said rotatable adjustment member having a first end which is insertable into a retention opening formed in said engine component, said rotatable adjustment member having a second end extending away from said engine component;

a head formed at said second end of said rotatable adjustment member;

a housing having walls which are shaped to at least partially surround said head, said rotational axis of said rotatable adjustment member extending through a first surface of said housing, said first surface extending perpendicularly from an internal surface surrounded by said housing walls;

an access opening formed in said first surface, said rotational axis of said rotatable adjustment member extending through said access opening; and an adjustment tool shaped to pass at least partially through said access opening, said adjustment tool having an operative end which is shaped to engage said head in torque transmitting relation, said operative end having a pair of inwardly facing surfaces which are shaped to receive a pair of outwardly facing surfaces of said head therebetween.

2. The system of claim 1, wherein:

said rotatable adjustment member is an idle fuel mixture screw.

3. The system of claim 1, wherein:

said engine component is a carburetor.

4. The system of claim 1, wherein:

said rotatable adjustment member is threaded into said retention opening.

5. The system of claim 1, wherein:

said access opening is a round hole extending through said first surface.

6. The system of claim 5, wherein:

said round hole has a diameter which is greater than a maximum thickness dimension of said operative end.

7. The system of claim 6, wherein:

said diameter is greater than a maximum thickness dimension of said head.

8. The system of claim 1, wherein:

said rotational axis of said rotatable adjustment member is generally perpendicular to said first surface.

9. The system of claim 1, wherein:

an internal surface of said housing defines a cavity, said head being spaced apart from said internal surface of said housing.

10. The system of claim 1, wherein:

the area of said access opening is less than twenty five percent of the area of said first surface.

11. An adjustment system for an engine, comprising:

a carburetor;

an idle fuel mixture screw shaped to be supported by said carburetor for rotation about a rotational axis, said idle fuel mixture screw having a first end which is insertable into a retention opening formed in said carburetor, said idle fuel mixture screw having a second end extending away from said carburetor;

a head formed at said second end of said idle fuel mixture screw;

a housing having walls which are shaped to at least partially surround said head, said rotational axis of said idle fuel mixture screw extending through a first surface of said housing, said first surface extending perpendicularly from an internal surface surrounded by said housing walls;

an access opening formed in said first surface, said rotational axis of said idle fuel mixture screw extending through said access opening; and an adjustment tool shaped to pass at least partially through said access opening, said adjustment tool having an operative end which is shaped to engage said head in torque transmitting relation, said operative end having a pair of inwardly facing planar surfaces which are shaped to receive a pair of outwardly facing planar surfaces of said head therebetween.

12. The system of claim 11, wherein:

said access opening is a hole extending through said first surface, said hole being shaped to permit a maximum thickness dimension of said operative end to pass therethrough.

13. The system of claim 12, wherein:

said rotational axis of said idle fuel mixture screw is generally perpendicular to said first surface.

14. The system of claim 13, wherein:

an internal surface of said housing defines a cavity, said head being spaced apart from said internal surface of said housing, the area of said access opening is less than thirty percent of the area of said first surface.

15. An adjustment system for an engine, comprising:

a carburetor;

an idle fuel mixture screw shaped to be supported by said carburetor for rotation about a rotational axis, said idle fuel mixture screw having a first end which is insertable into a retention opening formed in said carburetor, said idle fuel mixture screw having a second end extending away from said carburetor;

a head formed at said second end of said idle fuel mixture screw;

a housing having walls which are shaped to at least partially surround said head, said rotational axis of said idle fuel mixture screw extending through a first surface of said housing, said first surface extending perpendicularly from an internal surface surrounded by said housing walls;

an access opening formed in said first surface, said rotational axis of said idle fuel mixture screw extending through said access opening; and an adjustment tool shaped to pass at least partially through said access opening, said adjustment tool having an operative end which is shaped to engage said head in torque transmitting relation, said operative end having a pair of inwardly facing surfaces which are shaped to receive a pair of outwardly facing surfaces of said head therebetween.

16. The system of claim 15, wherein:

an internal surface of said housing defines a cavity, said head being spaced apart from said internal surface of said housing, the area of said access opening is less than fifty percent of the area of said first surface.

17. The system of claim 16, wherein:

said access opening is a hole extending through said first surface, said hole being shaped to permit a maximum thickness dimension of said operative end to pass therethrough.

18. The system of claim 17, wherein:

said rotational axis of said idle fuel mixture screw is generally perpendicular to said first surface.

* * * * *